US007827768B2

(12) United States Patent
Rosberg et al.

(10) Patent No.: US 7,827,768 B2
(45) Date of Patent: Nov. 9, 2010

(54) DEVICE AND A METHOD FOR CONTROLLING A TWIST OF A TUBE

(75) Inventors: Bengt Rosberg, Höör (SE); Andreas Asper, Malmö (SE); Claudio Ferrari, Fiorani (IT); Alberto Zambonelli, Modena (IT); Richard Pedretti, Casinalbo (IT); Andrea Manzini, Bagno (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 488 days.

(21) Appl. No.: 11/794,891

(22) PCT Filed: Dec. 8, 2005

(86) PCT No.: PCT/SE2005/001863

§ 371 (c)(1),
(2), (4) Date: Jul. 9, 2007

(87) PCT Pub. No.: WO2006/073339

PCT Pub. Date: Jul. 13, 2006

(65) Prior Publication Data

US 2009/0266034 A1 Oct. 29, 2009

(30) Foreign Application Priority Data

Jan. 10, 2005 (SE) ..... 0500074

(51) Int. Cl.
*B65B 5/02* (2006.01)

(52) U.S. Cl. ..... 53/452; 53/477; 53/51; 53/551; 53/389.4

(58) Field of Classification Search ..... 53/51, 53/52, 451, 452, 477, 547, 548, 550, 551, 53/552, 389.4, 389.5
See application file for complete search history.

(56) References Cited

U.S. PATENT DOCUMENTS 2,162,230 A * 6/1939 Salfisberg ..... 53/451

(Continued)

FOREIGN PATENT DOCUMENTS

EP 1 116 659 A1 7/2001

(Continued)

OTHER PUBLICATIONS

PCT/ISA/210 for PCT/SE2005/001863 dated May 10, 2006.

*Primary Examiner*—Paul R Durand
(74) *Attorney, Agent, or Firm*—Buchanan Ingersoll & Rooney PC

(57) ABSTRACT

A device for controlling a twist of a tube of packaging material in relation to an apparatus for transverse sealing of the tube comprises a number of rollers forming an aperture through which the packaging material is arranged to pass. A roller surface of each of the rollers is arranged to be in contact with an outer surface of the tube. The direction of the rotation axis of at least one of the rollers is adjustable to control the twist of the tube. A method for controlling a twist of a tube of packaging material comprises allowing the packaging material to pass through an aperture formed by a number of rollers with a rolling surface in contact with an outer surface of the tube, and adjusting the direction of the rotation axis of at least one of the rollers to control the twist of the tube.

26 Claims, 7 Drawing Sheets

U.S. PATENT DOCUMENTS

| | | | | | |
|---|---|---|---|---|---|
| 2,483,155 | A | * | 9/1949 | Salfisberg | 53/51 |
| 3,028,064 | A | * | 4/1962 | Thurlings | 226/30 |
| 3,276,183 | A | * | 10/1966 | Carlisle, Jr. et al. | 53/51 |
| 3,680,446 | A | * | 8/1972 | James et al. | 493/9 |
| 4,023,327 | A | * | 5/1977 | Simmons | 53/51 |
| 4,048,782 | A | * | 9/1977 | Hamilton | 53/51 |
| 4,081,944 | A | * | 4/1978 | Sjostrand | 53/51 |
| 4,384,438 | A | * | 5/1983 | Hilmersson | 53/51 |
| 4,754,593 | A | * | 7/1988 | Ishihara et al. | 53/51 |
| 4,766,716 | A | * | 8/1988 | Dominguez | 53/551 |
| 5,067,307 | A | * | 11/1991 | Francioni et al. | 53/450 |
| 5,203,760 | A | * | 4/1993 | Chen et al. | 493/302 |
| 5,295,942 | A | * | 3/1994 | Franklin | 493/302 |
| 5,727,366 | A | * | 3/1998 | Manly, Jr. | 53/451 |
| 5,767,491 | A | * | 6/1998 | Ohlsson et al. | 219/633 |
| 5,971,905 | A | * | 10/1999 | Fukuda | 493/3 |
| 6,079,188 | A | * | 6/2000 | Katayama et al. | 53/451 |
| 6,397,557 | B1 | * | 6/2002 | Bassissi et al. | 53/51 |
| 6,588,174 | B2 | * | 7/2003 | Yamamoto et al. | 53/51 |
| 7,448,189 | B2 | * | 11/2008 | Kinoshita et al. | 53/551 |
| 2004/0259709 | A1 | * | 12/2004 | Guidotti et al. | 493/356 |
| 2005/0016124 | A1 | * | 1/2005 | Kinoshita et al. | 53/64 |

FOREIGN PATENT DOCUMENTS

| | | | |
|---|---|---|---|
| EP | 1 468 914 | A1 | 10/2004 |
| GB | 1 373 203 | | 11/1974 |
| JP | 8-337219 | A | 12/1996 |
| WO | 00/44624 | A1 | 8/2000 |

* cited by examiner

DEVICE AND A METHOD FOR CONTROLLING A TWIST OF A TUBE

TECHNICAL FIELD OF THE INVENTION

The present invention relates to a device and a method for controlling a twist of a tube of packaging material in relation to an apparatus for transverse sealing of the tube.

BACKGROUND ART

Within packaging technology, use has long been made of packages for packing and transporting products such as milk, juice and other beverages. A large group of these packages is produced from a laminated packaging material comprising a core layer of, for example, paper or paper-board and an outer, liquid-tight coating of thermoplastic material on at least that side of the core layer which forms the inside of the package. Sometimes the material also includes a gas barrier, for example in the form of an aluminum layer.

Such packaging containers are often produced in that a web of packaging material is formed into a tube before sealing the longitudinal overlapping edges of the web. The longitudinally sealed tube is continuously filled with a product and then transversally sealed and formed into cushions. The sealing is made along narrow, transverse, mutually spaced apart, sealing zones. The transverse sealing of the tube takes place in a per se known manner substantially at right angles to the longitudinal direction of the tube and constantly in the same plane. The sealed-off portions of the tube thus containing contents are thereafter separated from the tube by means of incisions in these sealing zones.

The above mentioned forming of the web into a tube is effected by means of a number of tube forming means, usually rings, through which the web passes. When passing the last tube forming means, the tube is longitudinally sealed after which the tube is ready for filling and subsequent transverse sealing. During the transverse sealing, the tube is squeezed between two opposing jaws heating the thermoplastic material in the sealing zone. The location of the longitudinal seal in relation to the transverse seal on the final package will affect its appearance and function and should be essentially the same on every package of a certain kind. The twist of the tube in relation to the jaws in the moment of transverse sealing will determine this relative location of the longitudinal seal on the final package. For example, it is often desirable to have a certain décor on the packages, such as pictures and information describing the contents of the product. Further, since the area where the longitudinal seal intersects the transverse seal will contain three layers of packaging material instead of the common number of two, this area will be a critical one when it comes to sealing. The jaws may therefore be constructed in such a way as to provide for an increased heating in the intersection area. Therefore, the position of the longitudinal seal is crucial.

Due to different factors, such as web tension, unwanted twists of the tube may occur during manufacture. In a known machine for producing packages like the ones described above, such a twist can be adjusted prior to tube forming and longitudinal sealing by lightly pushing one of the longitudinal edges of the web. However, this method for adjusting the twist of the tube is most suitable in connection with use of relatively thick and rigid packaging materials. In a case where a thinner and less rigid material is used, there may be a risk that the web is being deformed by the pushing. Further, the adjustment of the twist is effected well in advance of the longitudinal sealing. Therefore, there may be a risk that a new unwanted twist of the tube is introduced after the pushing adjustment and before the longitudinal sealing.

SUMMARY OF THE INVENTION

An object of the present inventions is to provide a device and a method for controlling a twist of a tube of packaging material in relation to an apparatus for transverse sealing of the tube, which device and method, at least partly, eliminate the limitations of prior art. The basic concept of the invention is to control the twist of the tube by acting on the tube as such, not an unformed web of packaging material, whereby the invention is applicable to all types of packaging materials, relatively rigid as well as relatively thin ones.

The device and the method for achieving the object above are defined in the appended claims and discussed below.

A device for controlling a twist of a tube of packaging material in relation to an apparatus for transverse sealing of the tube according to the present invention is characterized by comprising a number of rollers forming an aperture through which the packaging material is arranged to pass. A rolling surface of each of the rollers is arranged to be in contact with an outer surface of the tube and a direction of a rotation axis of at least one of the rollers is adjustable so as to control the twist of the tube. It is known to use apertures formed by a number of fixed rollers in producing packages but for the different purpose of forming a tube from a web of packaging material. The use of apertures formed by rollers for controlling a tube twist, wherein at least one of the rollers has an adjustable direction of the rotation axis, is not previously known. One advantage with the present invention is therefore that it can be implemented by using known construction parts. Accordingly, already existing packaging machines can be modified so as to embody the inventive way of controlling the twist of a tube.

The apparatus for transverse sealing can operate in accordance with any suitable technique, such as for example ultrasonic sealing and induction heat sealing.

The device according to the present invention is applicable in connection with all kinds of tubes of packaging material, for example tubes with a continuous joint formed from a web of packaging material. Further, the device can be arranged to receive completely formed, and, in the case of the above example, thereby continuously sealed, tubes. Alternatively, the device can be arranged to instead complete the forming itself. According to one embodiment of the present invention, the device is arranged to receive a web of the packaging material and it further comprises a sealing element arranged to seal an overlapping continuous joint between two mutually opposing edge sections of the web. Here, the web can be received either already formed into an tube ready for sealing, or (partly) unformed in which case the device is arranged to perform a forming operation prior to continuous sealing.

The above embodiment is advantageous since it allows for at least two different important functions, i.e. continuous sealing of the tube and twisting correction of the same, to be performed in one and the same device. This, in turn, means that the twisting correction and continuous sealing can be performed close to each other so that no considerable new twisting can be introduced after the twisting correction prior to continuous sealing, such as in prior art. Additionally, this means that the number of components in a packaging machine can be reduced, resulting in a reduction in machine complexity and costs.

For the sake of clarity, it should be pointed out that the term tube, in the case of a tube formed from a web of packaging material, is used both for a sealed, and an unsealed but formed, tube. By completely formed tube is meant a tube ready for filling.

The sealing element can operate in accordance with any suitable technique for sealing, such as for example ultrasonic sealing, application of adhesive and induction heat sealing.

The construction of the device can be such that the sealing element is located opposite one of the rollers and arranged to be in contact with an inner surface of the tube. During continuous sealing, the joint is squeezed between the sealing element and said one of the rollers. This construction is advantageous in that it allows for the continuous sealing and the tube twist control to be effected simultaneously.

According to one embodiment, the aperture is arranged to give the tube a predetermined circumference. This embodiment is advantageous since it allows for yet another function, i.e. the function of (partly) forming the tube, besides for the twisting correction and potential continuous sealing, to be performed in one and the same device.

As discussed above, according to the present invention, at least one of the rollers is constructed in such a way that the direction of its rotation axis is adjustable. In one embodiment of the inventive device, the direction of the rotation axis of a plurality of the rollers is adjustable so as to control the twist of the tube. The more of the rollers included in this plurality, the more easily the twist of the tube can be controlled, since a fixed roller may counteract a twist adjustment.

In connection with the above embodiment, the device can be constructed in such a way that adjustments of the direction of the rotation axis of the plurality of the rollers are correlated. This is advantageous since it ensures that the rollers cooperate optimally and enables a relatively mechanically simple design of the device.

According to one embodiment of the present invention, the device can be such that the direction of the rotation axis is adjustable from a default direction essentially perpendicular to a longitudinal axis of the tube. By default direction is meant the direction of the rotation axis when no adjustment of the twist of the tube is necessary.

The inventive device can be constructed in such a way that the rolling surface of each of the rollers is concave. This may be beneficial since the outer surface of the tube usually is curved, whereby a concave surface generally will cause a larger contact area and friction between the rollers and the tube compared to a flat surface. In turn, this facilitates the control of the tube twist. Naturally, this is especially beneficial in embodiments where the device is arranged to receive a web of packaging material not yet completely formed into a tube since the aperture formed by the concave rollers may contribute to the tube forming/to keeping the form of the tube.

However, there may be situations where a large contact surface between the tube and the rollers involves a risk of damaging the packaging material but where it is still desirable to have a large friction between the tube and the rollers for facilitating the control of the tube twist. One example of such a situation is when the device is arranged to receive a completely formed and filled tube. Then, the rollers can be made of rubber or some other material giving rise to a relatively large friction, even with a small contact surface between the tube and the rollers. The rolling surface of each of the rollers could then, as an example, be plane or even convex.

The inventive device can be constructed so that the rotation axis coincides with a shaft through a centre of a corresponding one of the rollers. In accordance therewith, the adjustment can be effected by tilting an end of the shaft. Alternatively, the adjustment can be effected by tilting the ends of the shaft in opposite directions. Both ways of realizing the invention are relatively mechanically simple and stable.

The device according to the present invention can be constructed in such a way as to communicate with a twist detector, the twist of the tube being controlled as a function of an output from the twist detector. This enables continuous feedback regarding the twist of the tube and immediate correction if necessary. Such a detector can operate in accordance with any suitable technique for detection, such as optical detection.

In accordance with one embodiment, the device is constructed so that a size of the aperture formed by the rollers is adjustable. This feature is advantageous since it enables use of the device in connection with a large number of different tube sizes, and thereby a plurality of different types of packages.

A method for controlling a twist of a tube of packaging material in relation to an apparatus for transverse sealing of the tube according to the present invention is characterized by comprising allowing the packaging material to pass through an aperture, the aperture being formed by a number of rollers with a rolling surface arranged to be in contact with an outer surface of the tube. The method further comprises adjusting a direction of a rotation axis of at least one of the rollers to control the twist of the tube.

The characteristics discussed in connection with the device are, of course, transferable to the method according to the present invention. Further, it should be stressed that the above discussed characteristics may be combined in the same embodiment.

BRIEF DESCRIPTION OF THE DRAWINGS

The invention will be described in more detail with reference to the appended schematic drawings, which show examples of presently preferred embodiments of the present invention.

DETAILED DESCRIPTION OF PREFERRED EMBODIMENTS

Figure 1:
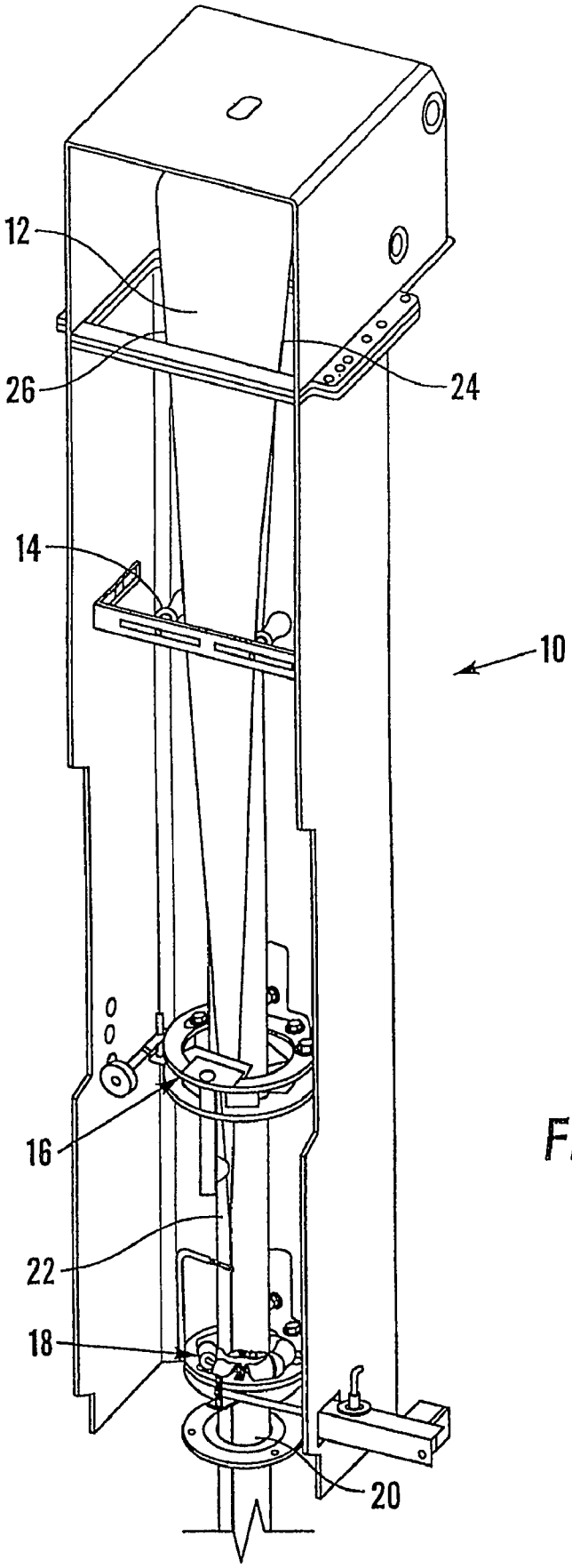
FIG. 1 is a perspective view of a part of a packaging machine comprising a device according to a first embodiment of the present invention.
Figure 2:
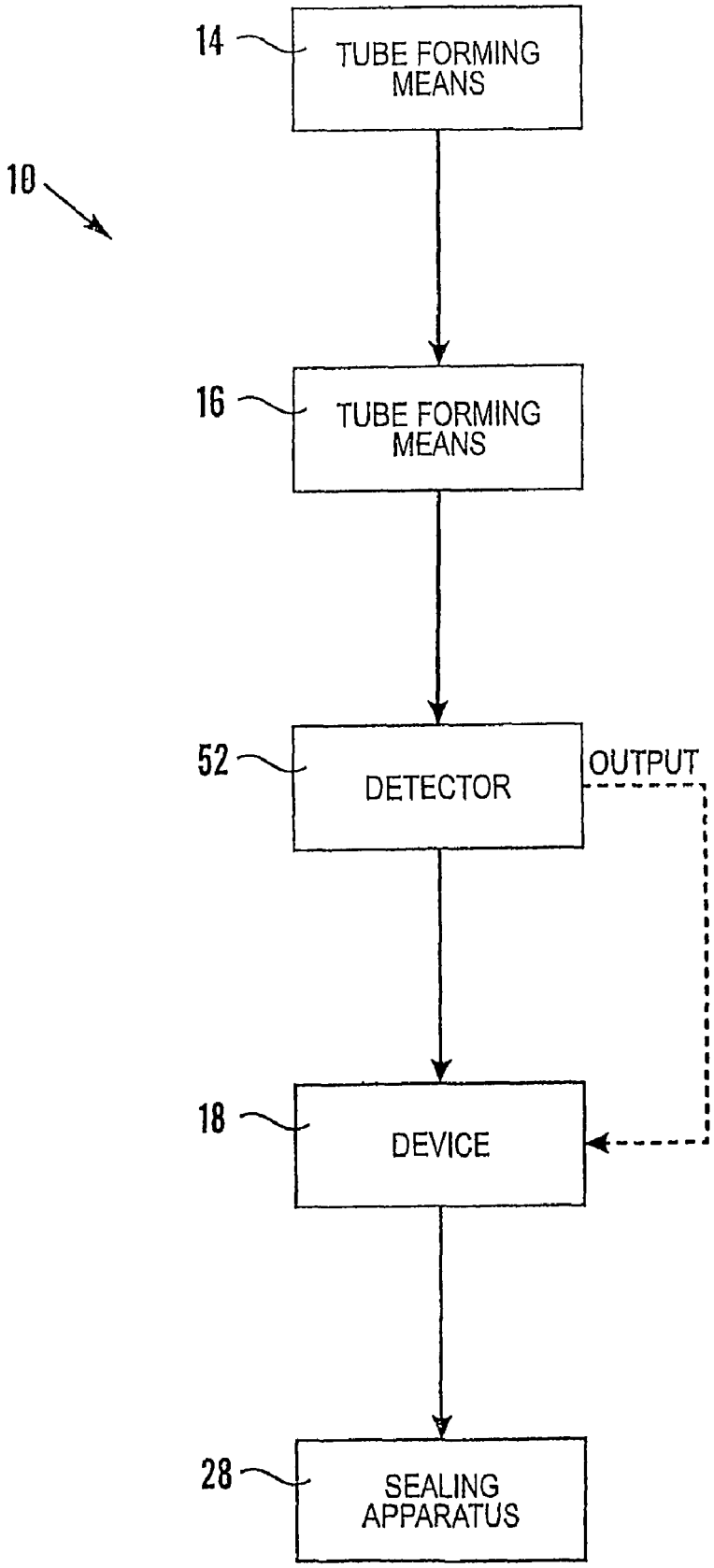
FIG. 2 is a block diagram corresponding to FIG. 1.
Figure 3:
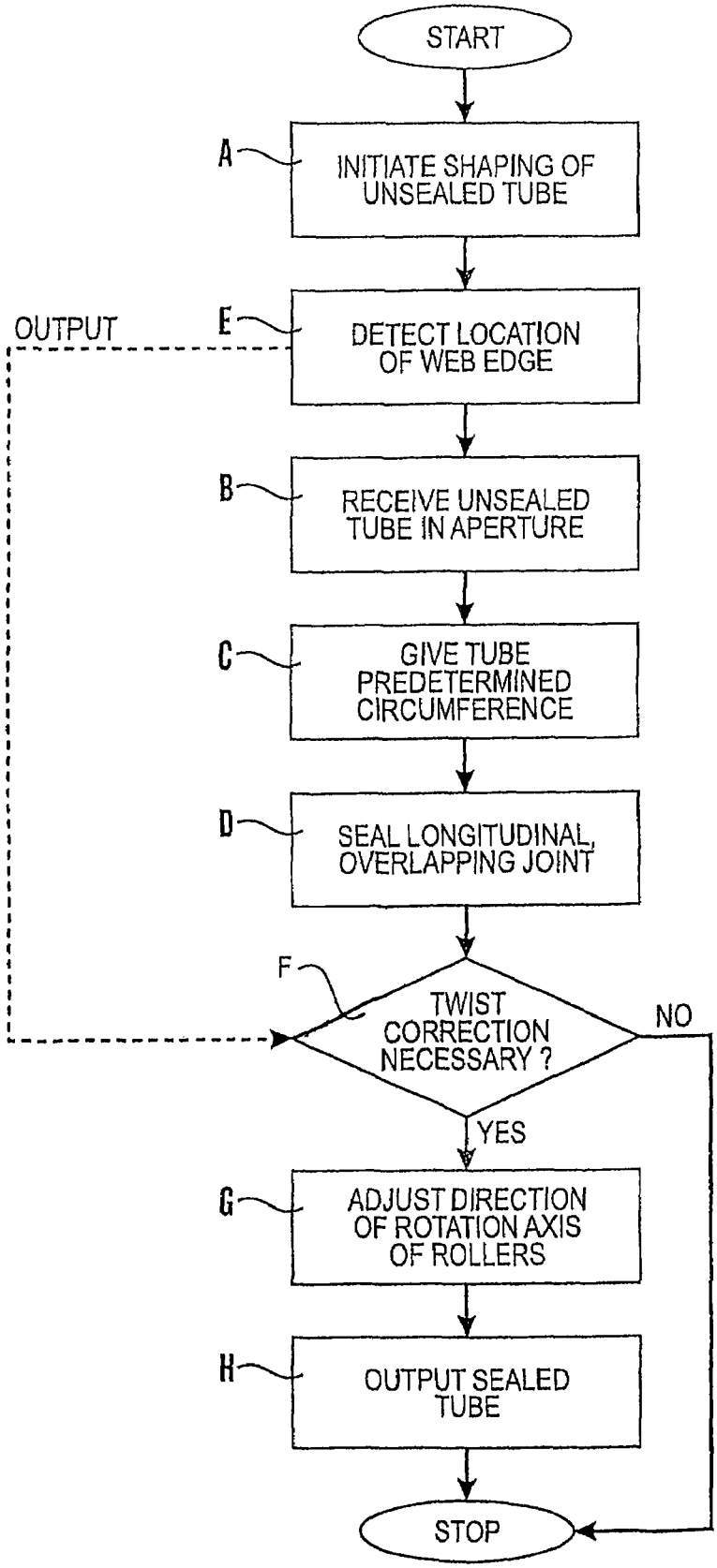
FIG. 3 is a flow chart corresponding to FIG. 1.

FIG. 1 illustrates a part 10 of a machine for manufacturing packages from a web 12 of packaging material. FIG. 2 contains a corresponding schematic block diagram of the machine part, whereas FIG. 3 contains a flow chart illustrating the corresponding method. The packaging material is of the initially described type, i.e. a paper core layer coated with a thermoplastic material. When passing through this particular part of the machine, a sealed tube is formed from the initially essentially plain web 12. The forming of the tube is effected by means of a number of tube forming means 14, 16 and a device 18 comprised in the machine 10. The device 18 is constructed in accordance with a first embodiment of the present invention. The main task of the tube forming means 14, 16 is to initiate shaping (step A) of the web 12 into a tube 20 with an overlapping joint 22 between two mutually opposing edge sections 24 and 26 of the web, and these means are not described in detail herein. The device 18 is arranged to control a twist of the tube in relation to a sealing apparatus 28 for transverse sealing of the tube. The sealing apparatus 28 is merely schematically illustrated in FIG. 2 and not described in detail herein. The device 18 is further arranged to finish the shaping of the web by giving the tube a desired diameter before longitudinally sealing the overlapping joint 22. This will be described in more detail below.

Figure 4:
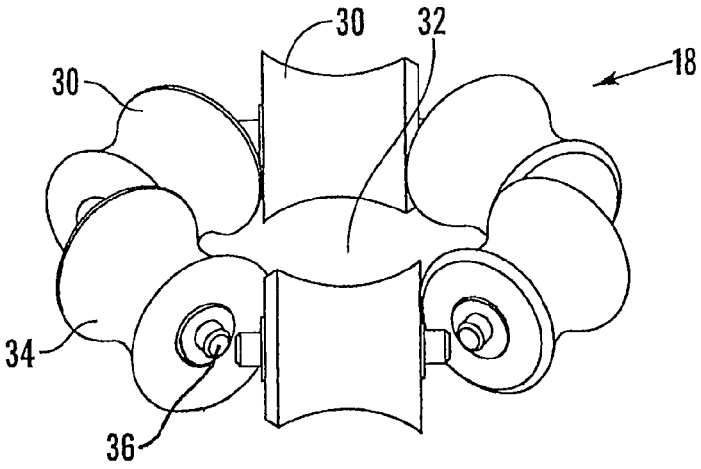
FIG. 4 is a partial perspective view of the device according to FIG. 1.
Figure 5:
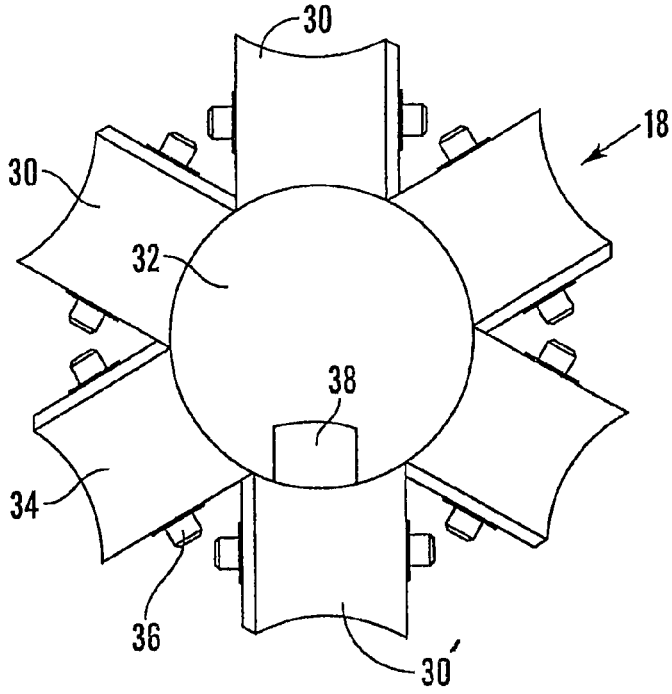
FIG. 5 is a partial top plan view of the device according to FIG. 1.
Figure 6:
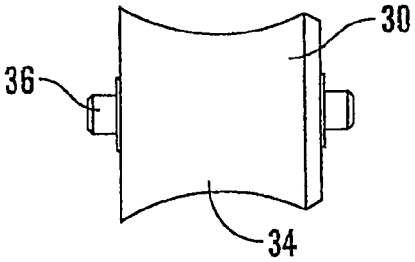
FIG. 6 is a top plan view of a part of the device illustrated in FIGS. 4 and 5.

The device 18 is partly illustrated, and more in detail, in FIGS. 4, 5 and 6. It comprises six similar stainless steel rollers 30 forming an essentially circular aperture 32 arranged to receive (step B) the unsealed, partially shaped, tube 20 of packaging material. The aperture will determine (step C) the final outer circumference of the sealed tube. When passing through the aperture 32, the tube 20 exerts a radial force onto the rollers and makes them roll due to the resulting friction. The rollers 30 each have a concave surface 34 for the purpose of obtaining a relatively large contact surface between the tube 20 and the device 18. Further, a shaft 36 defining the axis of rotation is arranged through a centre of each of the rollers 30. One of the rollers, the roller 30', effects (step D) the longitudinal sealing of the tube together with a sealing element in the form of a counter roller 38 arranged opposite the roller 30' inside the tube. For the sake of clarity, this sealing element can only be seen in FIG. 5. During the longitudinal sealing, the joint 22 is squeezed between the roller 30' and the sealing element 38, which work in accordance with any suitable sealing technology for sealing the joint.

Figure 7:
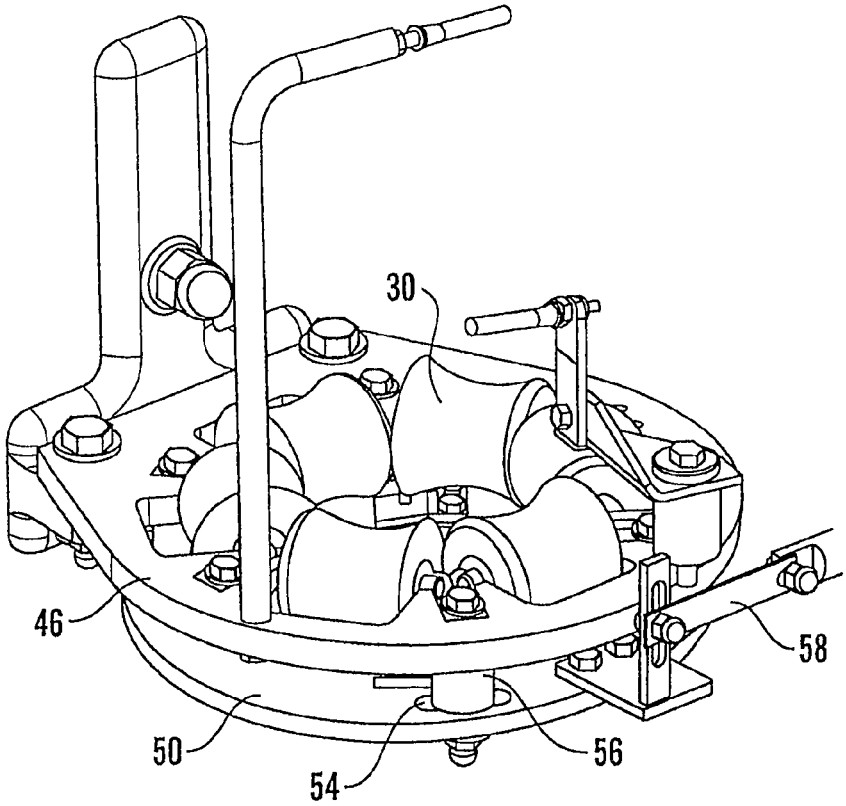
FIG. 7 is a partial perspective view of the device according to FIG. 1.
Figure 8:
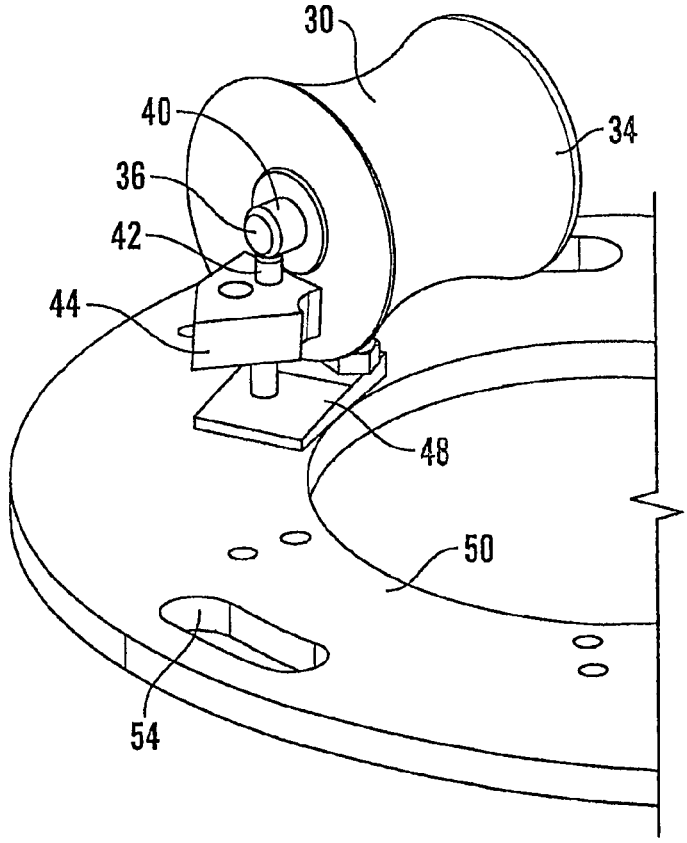
FIG. 8 is a detailed partial perspective view of the device according to FIG. 1.

The tube can become twisted during manufacturing for reasons such as non-uniform web tension. This may cause the initially discussed problems, that is, the risk of getting a misplaced décor and the risk of having difficulties with the transverse sealing in the area of intersection with the longitudinal seal. Therefore, as illustrated in FIGS. 7-8, the device 18 is constructed in such a way that the direction of the shafts 36, and therefore the axis of rotation, of the rollers 30 is adjustable so as to control the twist of the tube. For the purpose of clarity, only one of the rollers 30 is illustrated in FIG. 8. The default direction of the shaft 36 is essentially perpendicular to a longitudinal axis of the tube. If a correction of the twist of the tube in relation to the apparatus 28 for transverse sealing is required, one end 40 of the shaft is tilted from the default direction, either upwards for clockwise correction or downwards for counterclockwise correction, whereas the other end (not shown) of the shaft is kept still. The tilting is effected by means of a pin 42 arranged freely moveable through a hole in a bearing house 44 and carrying the end 40 of the shaft 36 of the roller 30. The bearing house 44 is fastened to a roller support plate 46 of the device 18. Underneath the bearing house 44, a wedge 48 is arranged against which the pin 42 is arranged to abut. The wedge 48 is fastened to a slide plate 50 of the device 18. The thickness of the wedge at the point of contact with the pin determines how much of the pin that is projecting from the bearing house and, in turn, the tilting degree (positive or negative with respect to the default direction) of the shaft 36. The direction of the shaft 36 is therefore adjusted by varying the location of the wedge 48 in relation to the bearing house 44. The roller support plate 46 and the slide plate 50 of the device are pivotally coupled whereby the adjustment is effected by a relative rotary motion between the two. The slide plate 50 is moving in relation to the roller support plate 46 which is kept stationary. The plates are connected by distance elements 56 attached to the roller support plate 46 and inserted through slots 54 in the slide plate 50. The distance elements 56 are connected to the slide plate 50 in such a way that the slide plate and the distance elements are movable in relation to each other. Further, the slide plate 50 is attached to an actuating means 58 (partly shown in FIG. 7) which effects the movement of the slide plate 50 in relation to the roller support plate 46.

The above description is directed towards one of the rollers, the other rollers, however, working in essentially the same way. Therefore, when a correction of the twist of the tube in relation to the apparatus 28 for transverse sealing is required, the direction of the shafts 36 of all the rollers 30 are adjusted in a correlated way by one single, common rotary motion.

In order to determine whether a correction of the twist of the tube in relation to the apparatus for transverse sealing is required or not, the device 18 is arranged to communicate with a twist detector 52, schematically illustrated in FIG. 2, as indicated by the dashed line. The twist detector 52 is arranged between the tube forming means 16 and the device 18, i.e. in a part of the packaging machine where the web is only partially formed into a tube. Here, the edge sections 24, 26, are not overlapping but still separated by a certain distance. The detector 52 optically detects (step E) the location of one of the longitudinal edges of the web by transmitting two parallel light beams and checking whether these beams are reflected or not. If no adjustment of the tube twist is required, i.e. if the location of the web edge is correct, one of the beams will hit the web and be reflected whereas the other beam will miss the web and not be reflected. Accordingly, if none of the beams is reflected, or both beams are reflected, an adjustment is necessary as will be communicated to the device 18. Thus, if it is determined (step F) that a twist correction is necessary, the direction of the rotation axis of all of the rollers is adjusted (step G) accordingly, whereas no such adjustment is effected otherwise. Therefore, when the tube is output (step H) from the device 18, it will have the correct twist with respect to the sealing apparatus 28.

In the embodiment above, although not apparent from the figures, the steps C, D, F and G are performed essentially simultaneously, numerous variations however being possible.

Further, although not described above, the sealed tube is naturally filled with the intended product prior to transverse sealing. For example, the sealed tube can be filled with a liquid product, such as a beverage.

Figure 9:
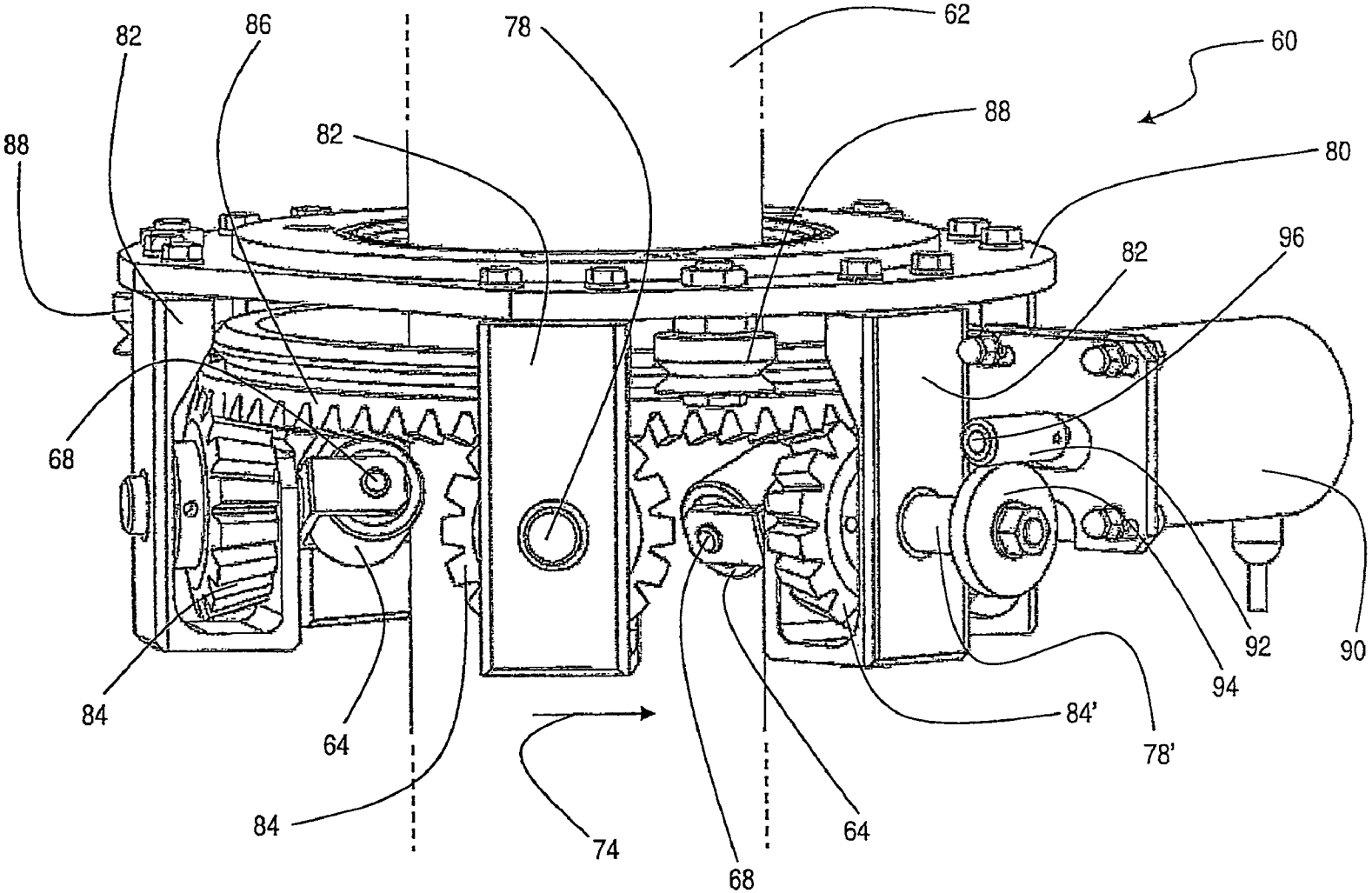
FIG. 9 is a partial perspective view of a device according to a second embodiment of the present invention.

FIG. 9 illustrates a device 60 constructed in accordance with a second embodiment of the present invention. Just like the above described device 18, the device 60 is arranged to be comprised in a machine for manufacturing packages from a web of packaging material of the initially described type. However, the device 60 is arranged to receive a completely formed, that is an already longitudinally sealed, and also filled tube 62. The longitudinal sealing is made at an earlier stage, for example in a final forming ring with sealing functionality as initially mentioned. Therefore, the positioning of the device 60 in the packaging machine is different from the positioning of the device 18 as illustrated in FIG. 1. The forming ring with sealing functionality is arranged upstream from the device 60 and downstream from a number of tube forming means similar to the tube forming means 14 and 16 described in connection with the first embodiment. Just like the device 18, the device 60 is arranged to control a twist of the tube in relation to a sealing apparatus for transverse sealing of the tube.

Figure 10:
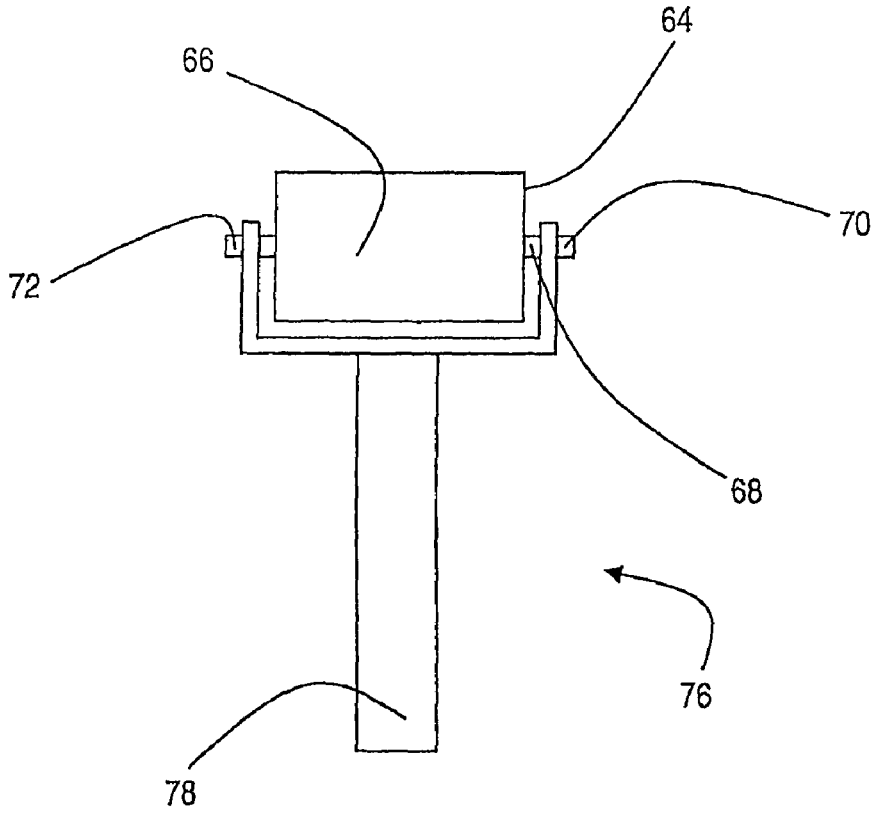
FIG. 10 is a top plan view of a part of the device illustrated in FIG. 9.

The device 60 comprises six similar rubber rollers 64 (of which only two can be seen in FIG. 9) arranged on the periphery of an imaginary circle through which the filled tube is to be passed. One of these rollers is illustrated in more detail in FIG. 10. When moving through the circle, the tube exerts a radial force onto the rollers and makes them roll due to the resulting friction. The rollers 64 each have a plane surface 66 for the purpose of ensuring a relatively small interface to the tube in order not to damage the packaging material. Further, a shaft 68 defining the axis of rotation is arranged through a centre of each of the rollers 64.

As previously described, the tube can, for various reasons, become twisted during manufacture. It is important to correct the twist in view of transverse sealing of the tube. The twist correction is also important in view of forming and longitudinal sealing of the tube. Therefore, the device 60 is constructed in such a way that the direction of the shafts 68, and therefore the axis of rotation, of the rollers 64 is adjustable so as to control the twist of the tube. The default direction of the shafts 68 is essentially perpendicular to a longitudinal axis of the tube. If a correction of the twist of the tube in relation to the apparatus for transverse sealing is required, one end 70 of each shaft is tilted from the default direction, either inwards or outwards in FIG. 10, whereas the other end 72 of each shaft is tilted in the opposite direction. In other words, if a tube correction is necessary, each shaft is turned around an axis extending radially from the centre of the tube to the centre of the shaft. When the rollers are tilted as illustrated in FIG. 9 the tube 62 is rotated in the direction 74.

Each of the shafts 68 is arranged in a respective holding means 76 having a rod 78 which coincides with the axis around which the shaft is turned in connection with tube twist correction, the turning being effected by rotating the rod 78. The device 60 further comprises a roller support plate 80 and six similar suspension means 82 equidistantly attached to the periphery thereof. A small conical gearwheel 84 is rotatably suspended in each one of the suspension means 82 by insertion of a respective one of the rods 78 through two concentric holes (not shown) in the suspension means and, there between, a centre hole (not shown) in the small gearwheel. The rods 78 are so connected to the respective small gearwheels 84 that a rotation of the small gearwheels results in a corresponding rotation of the rods 78. Further, the location of the rods 78 in the small gearwheels 84 is adjustable in a respective radial direction of the tube which means that the device can be used in connection with tubes of different sizes.

Further, the device 60 comprises a large conical gearwheel 86 connected to the roller support plate 80 by means of three similar support wheels 88 (of which only two can be seen in FIG. 9) equidistantly fastened to the periphery of the roller support plate. The large gearwheel 86, and therefore also the support wheels 88, are arranged to rotate in connection with a tube twist correction while the roller support plate 80 is arranged to always be stationary. As apparent from FIG. 9, the large gearwheel 86 engages with the small gearwheels 84, which makes the movement of all gearwheels correlated. Thus, the direction of the shafts 68 of all the rollers 64 can be adjusted by one single, common rotary motion of the large gearwheel 86 in relation to the roller support plate 80.

The device has a default state in which the large and small gearwheels are arranged in certain positions. In this default state the shafts of the rollers are arranged in the default direction which, as mentioned above, is perpendicular to a longitudinal axis of the tube 62. When the large gearwheel is turned, so are the small gearwheels, and the shafts of the rollers are tilted in accordance therewith. The size of the turn of the gearwheels determines the tilting degree of the rollers.

Finally, the device 60 comprises a step motor 90, a worm 92 and a gear 94. The worm 92 is attached to a shaft journal 96 of the step motor 90. Further, the worm 92 engages with the gear 94 which is fastened to one of the rods, rod 78'. As apparent from FIG. 9, the rod 78' is constructed somewhat differently from the other rods.

In order to determine whether a correction of the twist of the tube in relation to the apparatus for transverse sealing is required or not, the device 60 is arranged to communicate with a twist detector like the one discussed in connection with the first embodiment. If it is determined that a twist correction is necessary, the step motor 90 generates a rotational movement transmitted by the shaft journal 96 to the worm 92, and by the worm to the gear 94 and thereby the rod 78'. When the rod 78' starts to rotate, so does the small gearwheel 84' that is connected to the rod 78'. In turn, the large gearwheel starts to rotate and consequently also the rest of the small gearwheels.

In the embodiments above, the twist detector is arranged between the tube forming means and the device. However, a different twist detector could be used and arranged anywhere in the packaging machine, and is, according to another embodiment, arranged after the device for controlling the tube twist. In yet another embodiment, the twist detector is arranged before the tube forming means.

Further, all the rollers need not be similar and work in the same way. According to one embodiment, some of the rollers are stationary whereas the remaining ones have an adjustable rotation axis. According to yet another embodiment, some of the rollers have an adjustable rotation axis to effect the tube twist in the clockwise direction, whereas others have adjustable rotation axis to effect the tube twist in the counterclockwise direction.

The above described embodiments shall only be seen as examples. A person skilled in the art realizes that the embodiments discussed can be combined and varied in a number of ways without deviating from the inventive conception.

As an example, the aperture formed by the rollers need not be circular but could be of any shape. Also, any number of rollers could be used to form the aperture, six just being one possibility. Further, as apparent from the second embodiment, the rollers need not be arranged adjacent to each other to fully surround the tube. Instead, they can be separated by a certain distance. As an example, the aperture could be formed by two oppositely arranged rollers, the rolling surfaces of which cover only a part of the periphery of the tube.

Further, the mechanical constructions for adjusting the rotation axis of the rollers are just exemplary. Of course, any other suitable construction could be used in connection with the present invention.

The invention is not limited to use in connection with cushion shaped packages but could be used in manufacturing other types of packages, such as tetrahedron shaped and rectangular parallelepiped shaped packages.

Finally, it should be pointed out that the figures are not drawn according to scale.

The invention claimed is:

1. Method for controlling twist of a tube of packaging material in an apparatus for transverse sealing of the tube, comprising:

passing the packaging material through an aperture formed by outer rolling surfaces of a plurality of rollers in contact with an outer surface of the tube of packaging material, each of the rollers being rotatable about a rotation axis; and adjusting an orientation of the rotation axis of at least one of the rollers so that the rotation axis of the at least one roller forms an angle with a horizontal plane after the adjusting that differs from the angle of the rotation axis of the at least one roller relative to the horizontal place before the adjusting to control twist in the tube of packaging material.

2. Method according to claim 1, further comprising detecting an edge of the packaging material before the packaging material contacts the rollers to determine twist of the tube, and using the determined twist to control the adjusting of the orientation of the rotation axis of at least one of the roller.

3. Method according to claim 1, wherein the passing of the packaging material through the aperture comprises receiving a web of the packaging material in the aperture, sealing an overlapping joint between two mutually opposing edge sections of the web and outputting a sealed tube.

4. Method according to claim 3, wherein the sealing of the overlapping joint is effected essentially simultaneously with the control of the twist of the tube.

5. Method according to claim 1, further comprising giving the tube a predetermined circumference determined by the aperture.

6. Method according to claim 1, wherein adjusting the orientation of the rotation axis comprises adjusting it from a default direction essentially perpendicular to a longitudinal axis of the tube.

7. Method according to claim 1, wherein the rotation axis coincides with a shaft through a centre of a corresponding one of the rollers, and wherein adjusting the orientation of the rotation axis comprises tilting an end of the shaft.

8. Method according to claim 1, wherein the rotation axis coincides with a shaft through, a centre of a corresponding one of the rollers, and wherein adjusting the orientation of the rotation axis comprises tilting ends of the shaft in opposite directions.

9. Method according to claim 1, further comprising detecting a twist of the tube and, as a function of a result of the detection, controlling the twist of the tube.

10. Method according to claim 1, further comprising adjusting a size of the aperture to a size of the tube.

11. Method for controlling a twist of a tube of packaging material in relation to an apparatus for transverse sealing of the tube, comprising allowing the packaging material to pass through an aperture, the aperture being formed by a number of rollers with a rolling surface in contact with an outer surface of the tube, and adjusting a direction of a rotation axis of at least one of the rollers to control the twist of the tube, and adjusting the direction of the rotation axis of a plurality of the rollers to control the twist of the tube.

12. Method according to claim 11, comprising correlating adjustments of the direction of the rotation axis of the plurality of the rollers.

13. Device for controlling a twist of a tube of packaging material in relation to an apparatus for transverse sealing of the tube, comprising a plurality of rollers forming an aperture through which the packaging material is arranged to pass, each roller possessing a rolling surface and being rotatable about a respective rotation axis, the rolling surface of each of the rollers being arranged to contact an outer surface of the tube, and the rotation axis of at least one of the rollers being adjustable so that the rotation axis of the at least one roller forms an angle with a horizontal plane after being adjusted that differs from the angle of the rotation axis of the at least one roller relative to the horizontal place before being adjusted to control twist in the tube of packaging material.

14. Device according to claim 13, further comprising a sensor which detects an edge of the packaging material before the packaging material contacts the rollers to determine twist in the tube of packaging material, the rotation axis of the at least one roller being adjusted based on output from the sensor.

15. Device according to claim 13, wherein the device is arranged to receive a web of the packaging material and further comprising a sealing element arranged to seal an overlapping joint between two mutually opposing edge sections of the web.

16. Device according to claim 15, wherein the sealing element is located opposite one of the rollers and arranged to be in contact with an inner surface of the tube.

17. Device according to claim 13, wherein the aperture is arranged to give the tube a predetermined circumference.

18. Device according to claim 13, wherein a direction of the rotation axis is adjustable from a default direction essentially perpendicular to a longitudinal axis of the tube.

19. Device according to claim 13, wherein the rolling surface of each of the rollers is concave.

20. Device according to claim 13, wherein the rollers are made of rubber.

21. Device according to claim 13, wherein the rotation axis coincides with a shaft through a centre of a corresponding one of the rollers, the adjustment being effected by tilting an end of the shaft.

22. Device according to claim 13, wherein the rotation axis coincides with a shaft through a centre of a corresponding one of the rollers, the adjustment being effected by tilting ends of the shaft in opposite directions.

23. Device according to claim 13, arranged to communicate with a twist detector, the twist of the tube being controlled as a function of an output from the twist detector.

24. Device according to claim 13, wherein a size of the aperture is adjustable.

25. Device for controlling a twist of a tube of packaging material in relation to an apparatus for transverse sealing of the tube, comprising a number of rollers forming an aperture through which the packaging material is arranged to pass, wherein a rolling surface of each of the rollers is arranged to be in contact with an outer surface of the tube and a direction of a rotation axis of at least one of the rollers is adjustable so as to control the twist of the tube, wherein the direction of the rotation axis of a plurality of the rollers is adjustable so as to control the twist of the tube.

26. Device according to claim 25, wherein adjustments of a direction of the rotation axis of the plurality of the rollers are correlated.

* * * * *